US007395557B1

(12) United States Patent
Ledyard

(10) Patent No.: US 7,395,557 B1
(45) Date of Patent: Jul. 8, 2008

(54) SEAMLESS UPPER BODY GARMENT

(75) Inventor: Susan D. Ledyard, Kennett Square, PA (US)

(73) Assignee: Cass and Crew, L.L.C., Kennett Square, PA (US)

( * ) Notice: Subject to any disclaimer, the term of this patent is extended or adjusted under 35 U.S.C. 154(b) by 274 days.

(21) Appl. No.: 11/270,101

(22) Filed: Nov. 9, 2005

Related U.S. Application Data

(60) Provisional application No. 60/628,522, filed on Nov. 15, 2004.

(51) Int. Cl.
*A41B 9/06* (2006.01)
*D04B 1/24* (2006.01)

(52) U.S. Cl. ..... 2/113; 2/DIG. 1; 66/171

(58) Field of Classification Search ..... 2/67, 2/69, 406, 409, 407, 115, DIG. 1, 113, 109; 450/19, 108, 116; 66/161, 177, 171
See application file for complete search history.

(56) References Cited

U.S. PATENT DOCUMENTS 3,060,938 A * 10/1962 Kattermann et al. ..... 450/116
3,479,844 A * 11/1969 Silvain ..... 66/176
3,537,279 A 11/1970 Epley
4,236,257 A * 12/1980 Williams et al. ..... 2/406
4,400,832 A * 8/1983 Kinder ..... 2/406
4,412,433 A * 11/1983 Safrit et al. ..... 66/177
4,916,755 A * 4/1990 Feigenbaum et al. ..... 2/67
5,038,414 A * 8/1991 Freeman ..... 2/409
5,359,732 A * 11/1994 Waldman et al. ..... 2/67
5,431,030 A * 7/1995 Ishizaki et al. ..... 66/176
5,590,548 A * 1/1997 Osborne ..... 66/177
5,605,060 A * 2/1997 Osborne ..... 66/171
5,667,422 A * 9/1997 Erwin ..... 450/30
5,787,732 A * 8/1998 Perron et al. ..... 66/177
5,954,564 A * 9/1999 Ganz ..... 450/99
5,996,120 A * 12/1999 Balit ..... 2/67
6,000,993 A * 12/1999 Erwin ..... 450/7
6,047,406 A 4/2000 Dicker et al.
6,183,339 B1 * 2/2001 Thompson ..... 450/1
6,192,717 B1 * 2/2001 Rabinowicz ..... 66/177
6,276,175 B1 * 8/2001 Browder, Jr. ..... 66/171
6,393,611 B1 * 5/2002 Thompson ..... 2/55
6,427,493 B1 * 8/2002 Kasdan et al. ..... 66/169 R
6,430,748 B1 8/2002 Burkhart
6,430,753 B2 * 8/2002 Duran ..... 2/239
6,546,564 B1 * 4/2003 Palmer ..... 2/239
6,622,312 B2 * 9/2003 Rabinowicz ..... 2/401
6,874,337 B2 * 4/2005 Uno et al. ..... 66/177
6,918,140 B1 * 7/2005 Cooper ..... 2/228
6,993,940 B2 * 2/2006 Rabinowicz et al. ..... 66/176
7,024,892 B2 * 4/2006 Blakely ..... 66/177
7,083,494 B2 * 8/2006 Sandroussi et al. ..... 450/31
7,260,961 B1 * 8/2007 Kennedy ..... 66/177
2001/0054303 A1 * 12/2001 Browder, Jr. ..... 66/171
2002/0022433 A1 * 2/2002 Yeung et al. ..... 450/70
2002/0152775 A1 10/2002 Browder, Jr.

(Continued)

*Primary Examiner*—Alissa L Hoey
(74) *Attorney, Agent, or Firm*—Panitch Schwarze Belisario & Nadel LLP

(57) ABSTRACT

A seamless women's upper body garment that functions to lift and enhance the bust line, slim and smooth the upper body and help to improve wearer's posture without creating unsightly visible back lines and bulging. The garment comprises a circumferential band below the bust line and dorsal and ventral vertical support panels.

11 Claims, 2 Drawing Sheets

U.S. PATENT DOCUMENTS

2003/0019251 A1* 1/2003 Browder et al. ..... 66/171
2003/0131394 A1 7/2003 Chou
2003/0192351 A1* 10/2003 Meckley et al. ..... 66/170
2004/0006811 A1 1/2004 McKenzie
2004/0014394 A1* 1/2004 Mitchell et al. ..... 450/65
2004/0016041 A1 1/2004 Uno et al.
2004/0045325 A1* 3/2004 Rabinowicz et al. ..... 66/176
2004/0049834 A1* 3/2004 Stangle et al. ..... 2/338
2004/0137821 A1* 7/2004 Sandroussi et al. ..... 450/34
2005/0005340 A1* 1/2005 Roux et al. ..... 2/69
2006/0021388 A1* 2/2006 Mitchell et al. ..... 66/176
2006/0166600 A1* 7/2006 Ravoiu et al. ..... 450/7
2007/0050881 A1* 3/2007 Kasprzak ..... 2/69
2007/0163026 A1* 7/2007 Perry ..... 2/69

* cited by examiner

SEAMLESS UPPER BODY GARMENT

CROSS-REFERENCE TO RELATED APPLICATION

This application claims the benefit under 35 U.S.C. § 119 (e) to U.S. Provisional Patent Application No. 60/628,522, filed Nov. 15, 2004.

BACKGROUND OF THE INVENTION

The present invention relates to garments, particularly those that can be worn as women's undergarments or as day wear. In particular, the present invention relates to an improved seamless upper body garment of unitary construction.

No matter how slender a woman is or how much exercise a woman does, girdles and bras can create visible back lines and bulging. A wide variety of girdles and bras have been available for hundreds of years, all sacrificing a smooth, lineless back for full support in the front. In the past, full support could not be achieved without uncomfortable, unsightly back straps. Prior undergarments resulted in visible lines from supporting members such as bra straps and internal shelf bras, and from seams that formed the edges of bras and panties. In addition, prior undergarments caused a wearer's extra flesh to be forced into unsightly bulges.

SUMMARY OF THE INVENTION

The present invention provides a solution to the problems outlined above, and provides a means for slimming and sculpting the wearer's body without any visible lines and without causing any unsightly bulges. The present invention provides a means for sculpting the exterior surface of the body by exerting forces on the body to compress and control various portions of the body, while allowing free movement. The present invention provides upper body garments that are made from breathable fabric, and that can have breathable portions thereof, and that lack unsightly seams or visible support members such as straps.

Specifically, the present invention provides a seamless women's knitted upper body garment comprising a substantially horizontal circumferential support band, and a dorsal and a ventral substantially vertical support panel contiguous with the circumferential band.

DETAILED DESCRIPTION OF THE INVENTION

The present invention will be more fully understood by reference to the drawings and description below. Variations and modifications thereof are within the scope of the invention, and will be obvious to those skilled in the art.

Figure 1:
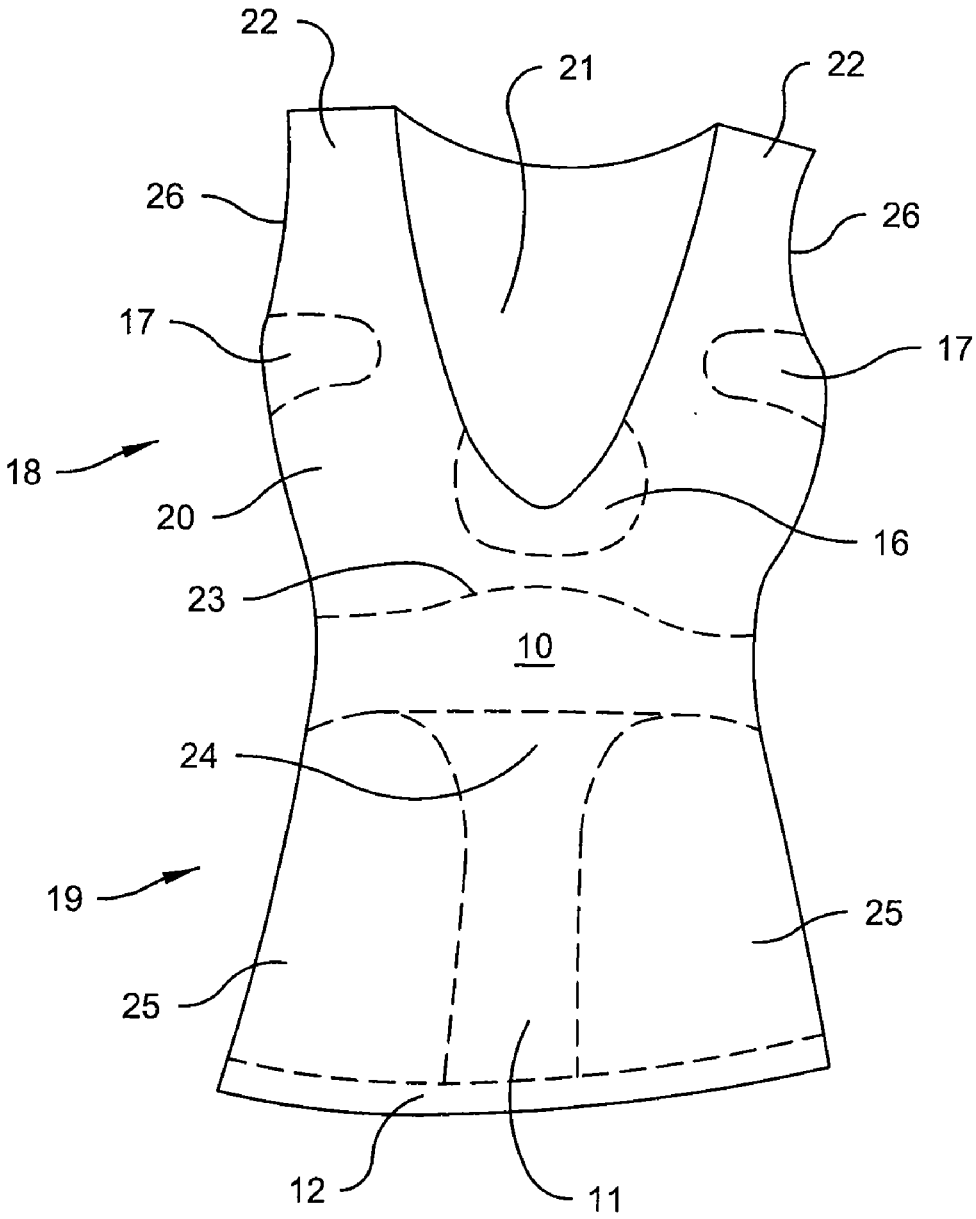
FIGS. 1 and 2 are front and back views, respectively, of the garments of the present invention.

FIG. 1 is a front plan view of a knitted upper body garment of the present invention. The garment has an upper torso region 18 and a lower torso region 19. The upper torso region 18 includes a bust area 20 that may be connected to an upper back area 21 by shoulder straps 22. A horizontal circumferential support band 10 is positioned just below the bust line 23. The band 10 completely encircles the garment, and is generally about from 1-4 inches wide, and preferably about 1 inch wide, extending toward a waist region 24 separating the upper torso region 18 from the lower torso region 19.

The garment further comprises side portions 25 flanking a ventral substantially vertical support panel 11. The vertical ventral support panel is contiguous with the circumferential band 10, and is typically about from 3 to 8 inches wide. The side portions 25 and the ventral vertical support panel 11 extend downward from the bottom of the circumferential support band 10. Accordingly, the vertical ventral panel 11 is typically about from 12 to 15 inches long, and preferably about 13 inches long, extending to a hem 12. The side portions 25 also extend to the hem 12.

Figure 2:
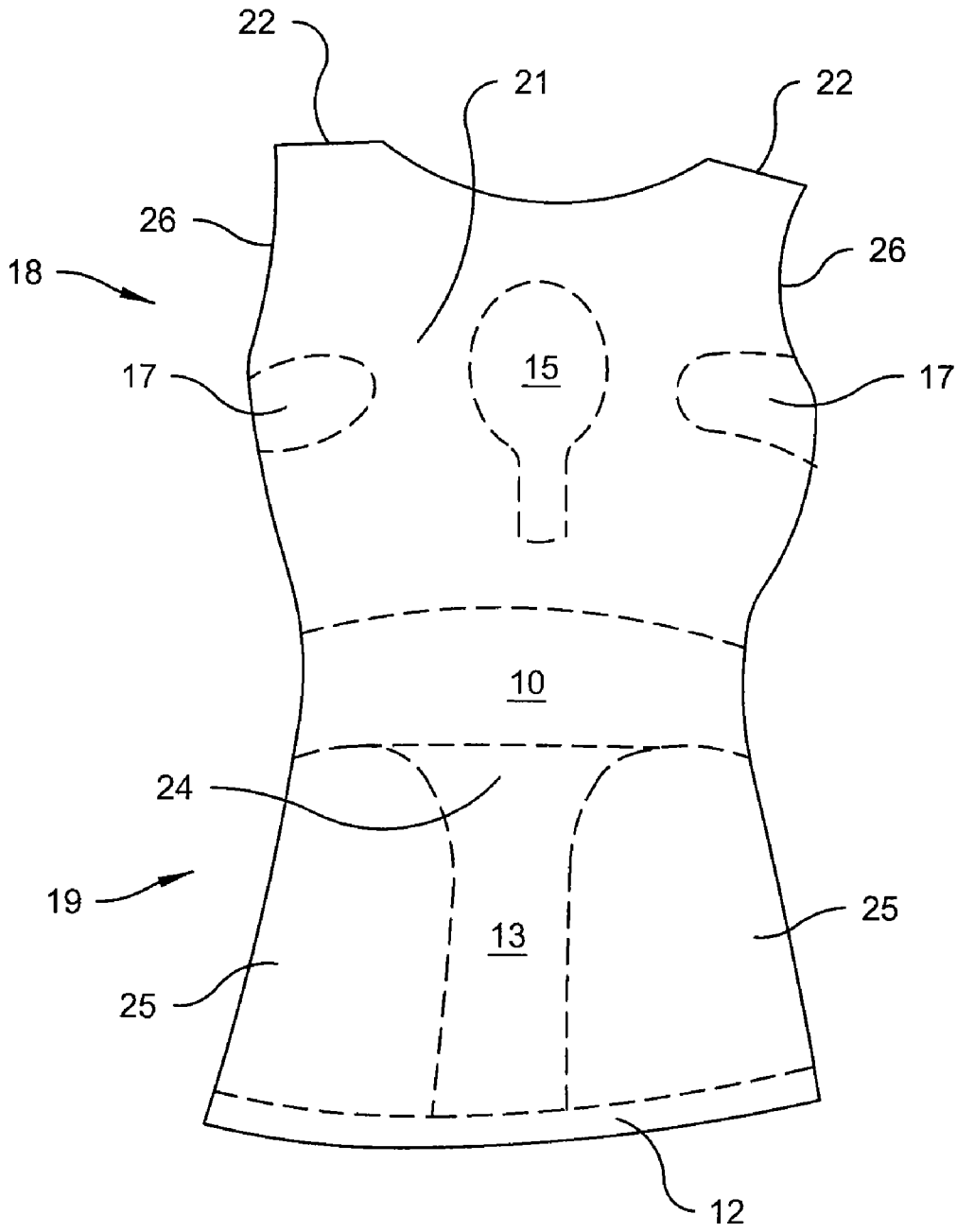

As shown in FIG. 2, the garments of the present invention also comprise a dorsal substantially vertical support panel 13 flanked by the side portions 25. As with the ventral panel 11, the dorsal panel 13 preferably extends from the bottom of the circumferential support band 10 to the bottom hem 12 of the garment.

The garments of the present invention preferably further comprise a dorsal ventilation portion 15, as shown in FIG. 2. It is also preferred that the garments comprise a ventral ventilation portion, as shown in FIG. 1 as 16. It is further preferred that the garments comprise side ventilation panels 17. The side ventilation panels, where present, can be prepared using a pique stitch in the knit, although other stitches can be used, as will be evident to those skilled in the knitting art.

The garments of the present invention can be prepared with a conventional circular knitting machine. Two such machines which can be used in preparation of the garments of the instant invention are those commercially available from Santlori and Sangiacamo. In the operation of such knitting machines, the particular configuration of the knit is programmed into the machine. A variety of stitches can be used to prepare the garments of the present invention, including, for example, 2×1 ribbing, waffle or tucking stitch and pique stitching. The stitch is adjusted to provide the required circumferential band and the dorsal and ventral panels. In general, the side panels 17, where present, and the side portions 25 have a lower elasticity than the circumferential band or the dorsal or ventral panels. Typically, the side panels 1, where present, have an elasticity of about from 10-15%. A pique stitch is preferred for side panels 17, when used.

The stitching in the knitting and the yarns used are adjusted to provide increased elasticity in the required components in the present garments. The circumferential band 10 and the specified panels 11 and 13 should provide, through selection of the knitting yarn and the stitch used in the production of the garment, an elasticity of at least about 15%, and preferably at least about 30%, and especially at least about 40%, greater than the elasticity of those portions of the garment other than the dorsal or ventral panels and the circumferential band.

The knit of the overall garment can be adjusted on the knitting apparatus. A maximum stretch of about from 40 to 50% is typically used, and a maximum stretch of about 44% is particularly preferred.

In the construction of the present garments, arm holes 26 are positioned short, such that their lower edges sit immediately below the average size women's underarms so that no excess skin or bulge can occur, and re-distribution of any such skin would be beneath the garment.

The yarn used in the preparation of the garments of the instant invention can be selected from a wide variety of known textile yarns with an elasticity of least about 5%. The specific polymer used can vary widely, and can be selected, for example, from nylons, elastomeric polyesters, polyester microfiber, and spandex. A blend of microfiber nylon and spandex is preferred in the present invention, especially in a ratio of about 95/5 percent by weight.

The garments of the present invention, when worn, lift the bust line comfortably without causing visible back lines and bulges, gently slim the torso from a point below the bust line to the area below the hips, create a smooth and bulge-free back as excess skin is distributed evenly, and are lightweight and breathable. In addition, the garments can be worn for both under and outer wear.

The garments can have the general shape of a conventional women's top and generally fit over the head and encircle the upper body from the neck down to the hips. Various necklines and overall designs can be used, including V-neck, scoop, crew, cami and bustier. With some designs, the wearer can step into the garment rather than putting it on over the head.

The material of manufacture can be any lightweight, soft, breathable comfortable material that contains an elastomeric component or is elastomeric. Representative elastomeric materials which can be used include spandex and microfiber stretch nylon. Such material and fabric are known in the art. Preferably, the garment includes an extra long tail so that it will remain tucked in.

The back portion 21 of the present garments extending around from the bust area 20 encircles the upper middle back and shapes the upper back and lifts the bust line without creating visible bra lines in the back area. The invisible bra effect could not be accomplished without both styling and a variety of commonly used seamless stitching. The styling is accomplished by the position of the alternate stitching. One type of stitching provides general support, and another is more tightly constricting, thus shaping the desired areas. The lower torso region 19 of the garment can comprise circumference compression features created by stitching and a combination of stretch yarns that gently shapes and smoothes the wearer's lower torso from the bust line 23 down to the hips; effectively and strategically smoothing the area about the pant line and not allowing for bulging of the body. Further, the area of the garment vertically in the front and back deferred by the support panels 11 and 13 can comprise a vertically oriented structure, created by the inclusion of an alternate material and/or alternate stitching pattern, to help slim and smooth both middle sections in the front of the abdomen and middle of back (one could not work without the other) as well as helping to improve posture.

The seamless garments of the present invention evenly distribute the pressure throughout the wearer's back in order to provide full support in the front. The result is a smooth, lineless back. The circumferential horizontal band in the present garments permits the bust line to be lifted and enhanced.

Gentle slimming and smoothing is accomplished in the garments of the present invention with the combination of yarns, panels and bands of the garments. Many shapers and bras previously available create bulges due to stopping and starting of materials. For example, a bra's back straps cut into the middle of back and make skin bulge, and bustier shapers create a bulge across the top of the back Similarly, shelf bras, which have been used internally in garments create bulges and lines. The garments of the present invention seamlessly cover the large areas so there is no stopping or starting of materials from the neck to under the hips. The garments create a smooth lineless back and evenly distribute excess skin through the torso.

With the increased popularity of low rise pants, many average size women have bulges above the pant-line. A preferred embodiment of the garment of the present invention includes an extra long tail. In this embodiment, the tail extends from 20 to 22 inches from the collar to the hem 12 of the garment, and preferably about 21 inches. The extension of the dorsal vertical support panel 13 to the bottom of the garment further aids the performance of the garment in this regard. This longer tail helps to slim the area and evenly distribute excess skin above the pant line, creating a smoother, bulge free look. To achieve the desired slimming and smoothing, pique and waffle stitching can be placed in the preferred ventilation panels under the arms, along the middle of the back, and along the sides side portions 25 of the torso. The pique and waffle stitching can also be used to increase breathability of the garment.

Many garments previously used can be worn for a limited time due to tight, unbreathable fabric. The garments of the present invention, made using a blend of yarns (micro-fiber nylon and Lycra) and using stitching patterns that yield superior breathability allow for 24 hour comfort and all season wear. In addition, pique stitching can be used for ventilation, and ventilation panels 15 and 17 can be located on the back and under the arms on the garment. Two by one stitching can be used to provide support and control, while other combinations can be used.

The garments of the present invention, with their combination of panels and bends, can improve posture. Most other garments that support and slim below the abdomen have snaps in the groin area to hold them in place. The garments of the present invention, with the specified combination of unitary construction and integrated band and panels, help to prevent roll-up.

A welt knit or hem can be added to bottom of the tail of the garment to help keep the garment below the hips. The welt can comprise an elastic, a microfiber, spandex, or a combination of these fibers. The dimensions of this element will vary with the style of the garment and the specific fiber used for the construction.

The garments of the present invention can be made from a wide variety of materials. A variety of commonly used seamless stitching patterns along with styling and advanced elastic yarns all in combination create a breathable, comfortable top that can be worn as inner or outer and exercise wear. Signature components of these tops can include fall support that lifts and enhances the bust, noticeable all over upper body slimming, and improved posture; all without creating visible back lines and bulges.

I claim:

1. A seamless women's knitted upper body garment comprising an upper torso region and a lower torso region, the upper torso region including a bust area having a bust line and a back area, the garment further comprising a waist region between the upper region and the lower region and a substantially horizontal circumferential support band extending from just below the bust line toward the waist region, a dorsal substantially vertical support panel and a ventral substantially vertical support panel, the dorsal and ventral substantially vertical support panels being contiguous with the circumferential band and having the same stitching as the circumferential band, the dorsal and ventral substantially vertical support panels being flanked by side portions of the garment, the side portions extending from the circumferential band to a lower hem forming the bottom of the garment at a hip area of a user of the garment.

2. A seamless garment of claim 1 further comprising two side ventilation panels.

3. A seamless garment of claim 2 wherein the side ventilation panels are prepared using a waffle or tucking stitch.

4. A seamless garment of claim 2 wherein the side ventilation panels are prepared using a pique stitch.

5. A seamless garment of claim 1 fabricated from at least one yarn selected from the group consisting of spandex, polyester, nylon, elastomeric material, polyester microfiber, and elastomeric fiber.

6. A seamless garment of claim 5 comprising a blend of nylon and spandex.

7. A seamless garment of claim 6 wherein the nylon and spandex are present in the yarn in a ratio of about 95/5 percent by weight.

8. A seamless garment of claim 7 wherein the nylon comprises microfiber nylon.

9. A seamless garment of claim 1 in which the dorsal support panel extends about from 20 to 22 inches from the collar to the bottom of the hem.

10. A seamless garment of claim 9 wherein the dorsal support panel extends about 21 inches from the collar to the bottom of the hem.

11. A seamless garment of claim 1 wherein the dorsal and ventral substantially vertical support panels extend to the bottom of the hem.

* * * * *